US009587595B2

(12) United States Patent
Woods et al.

(10) Patent No.: US 9,587,595 B2
(45) **Date of Patent: *Mar. 7, 2017**

(54) ACTIVE PURGE PUMP SYSTEM MODULE FOR EVAPORATIVE EMISSION CONTROL SYSTEM

(71) Applicant: Continental Automotive Systems, Inc., Auburn Hills, MI (US)

(72) Inventors: Brian G. Woods, Chatham (CA); Thierry Collet, Fontenilles (FR); Manfred Weigl, Sinzing (DE)

(73) Assignee: Continental Automotive Systems, Inc., Auburn Hills, MI (US)

( * ) Notice: Subject to any disclaimer, the term of this patent is extended or adjusted under 35 U.S.C. 154(b) by 241 days.

This patent is subject to a terminal disclaimer.

(21) Appl. No.: 14/513,239

(22) Filed: Oct. 14, 2014

(65) Prior Publication Data

US 2015/0159597 A1 Jun. 11, 2015

Related U.S. Application Data

(60) Provisional application No. 61/914,668, filed on Dec. 11, 2013, provisional application No. 62/007,660, filed on Jun. 4, 2014.

(51) Int. Cl.

| | |
|---|---|
| ***F02M 25/08*** | (2006.01) |
| ***F02M 33/02*** | (2006.01) |
| *F02D 41/00* | (2006.01) |

(52) U.S. Cl.

CPC ..... *F02M 25/089* (2013.01); *F02M 25/0818* (2013.01); *F02M 25/0836* (2013.01);
(Continued)

(58) Field of Classification Search

CPC ..... F02M 25/0836; F02M 25/089; F02M 25/0827; F02M 25/0809; F02M 25/0854;
(Continued)

(56) References Cited

U.S. PATENT DOCUMENTS 5,992,396 A * 11/1999 Krimmer ..... B60K 15/03504 123/519
6,196,202 B1 * 3/2001 Busato ..... F02M 25/089 123/198 D (Continued)

FOREIGN PATENT DOCUMENTS

| | | |
|---|---|---|
| DE | 19644610 A1 | 4/1998 |
| DE | 69803390 T2 | 2/2002 |
| DE | 102010064240 A1 | 6/2012 |

*Primary Examiner* — Thomas Moulis
*Assistant Examiner* — George Jin

(57) ABSTRACT

An active purge pump system module is provided for an evaporative emission control (EVAP) system for a vehicle. The EVAP system includes a fuel tank, a vapor collection canister in communication with the fuel tank, an air intake, and a purge valve connected between the canister and the air intake. The active purge pump system module includes a pump in fluid communication with the canister to move air independently of operation of the engine. A bypass valve assembly communicates with an upstream side and a downstream side of the pump to bypass the pump. In a closed position of the bypass valve assembly, the pump, when activated, moves purge vapor from the canister, through the purge valve, and to the engine to be consumed during combustion, and when the bypass valve assembly is opened and the pump is deactivated, vehicle refueling is permitted.

18 Claims, 3 Drawing Sheets

(52) U.S. Cl.
CPC ..... *F02M 25/0872* (2013.01); *F02M 33/025* (2013.01); *F02D 41/0032* (2013.01)

(58) Field of Classification Search
CPC ..... F02M 25/0872; F02M 25/0818; F02M 33/02; F02M 33/025; F02M 33/04; F02D 41/003; F02D 41/004; F02D 41/0032
See application file for complete search history.

(56) References Cited

U.S. PATENT DOCUMENTS

| | | | | |
|---|---|---|---|---|
| 2002/0076336 | A1 | 6/2002 | Mruk et al. | |
| 2004/0089063 | A1* | 5/2004 | Matsubara | F02M 25/089 73/114.41 |
| 2004/0173013 | A1* | 9/2004 | Kobayashi | F02M 25/0818 73/114.41 |
| 2011/0132331 | A1* | 6/2011 | Pursifull | F02B 37/127 123/478 |
| 2013/0255645 | A1* | 10/2013 | Grass | F02M 25/0818 123/520 |
| 2014/0013944 | A1* | 1/2014 | Haag | F02M 25/0818 95/146 |
| 2014/0174411 | A1* | 6/2014 | Matsunaga | F02M 25/0836 123/520 |
| 2014/0345573 | A1* | 11/2014 | Jefford | F02M 25/0836 123/519 |

* cited by examiner

ACTIVE PURGE PUMP SYSTEM MODULE FOR EVAPORATIVE EMISSION CONTROL SYSTEM

FIELD

The invention relates generally to an evaporative emission control system for a vehicle and, in particular, to an active purge pump system module that to actively pushes or pulls purge vapor from a carbon canister.

BACKGROUND

Carbon canisters are commonly used to store purge vapor from a fuel tank until the purge vapor can be disposed of. Most vehicles have an evaporative emission control (EVAP) system that is used to remove purge vapor from the canister, and transfer the purge vapor to the engine, where the purge vapor is burned off during combustion. One type of EVAP system uses manifold vacuum to draw air through the canister and pull the vapors into the engine. However, systems which use manifold vacuum may not always generate enough vacuum to draw sufficient amounts of air through the canister to pull the purge vapor into the engine. With turbocharged engines, the manifold pressure is used with a venturi-style of nozzle to create a vacuum for purging. The drawback to this approach is that directing pressurized air away from the turbocharger for use in purging, reduces the efficiency of the turbocharger and reduces the amount of power increase to the engine.

Accordingly, there exists a need for an evaporative emission control system that provides for sufficient transfer of purge vapor to the engine, without sacrificing engine efficiency.

SUMMARY

An objective of the invention is to fulfill the need referred to above. In accordance with the principles of the embodiments, this objective is achieved by providing an active purge pump system module for an evaporative emission control system for a vehicle. The evaporative emission control system includes a fuel tank, a vapor collection canister in communication with the fuel tank, an air intake directing air to an internal combustion engine of the vehicle, and a purge valve connected between the canister and the air intake. The active purge pump system module includes a pump in fluid communication with the canister. The pump is constructed and arranged to move air independently of operation of the engine. A bypass valve assembly is in fluid communication with an upstream side and a downstream side of the pump so as to bypass the pump. The bypass valve assembly is constructed and arranged to be moved between opened and closed position such that when in the closed position, the pump, when activated, is constructed and arranged to move purge vapor from the canister, through the purge valve, and to the engine to be consumed during combustion, and when the bypass valve assembly is opened and the pump is deactivated, vehicle refueling is permitted.

In accordance with another aspect of an embodiment, a method of purging vapor from a vehicle is provided. The vehicle has an evaporative emission control system including a fuel tank, a vapor collection canister in communication with the fuel tank, an air intake directing air to an internal combustion engine of the vehicle, and a purge valve connected between the canister and the air intake. The method provides a pump in fluid communication with the canister. The pump is operated independently of the engine to move purge vapor from the canister, through the purge valve, and to the engine to be consumed during combustion.

Other objectives, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

The following description of the preferred embodiment(s) is merely exemplary in nature and is in no way intended to limit the invention, its application, or uses.

Figure 1:
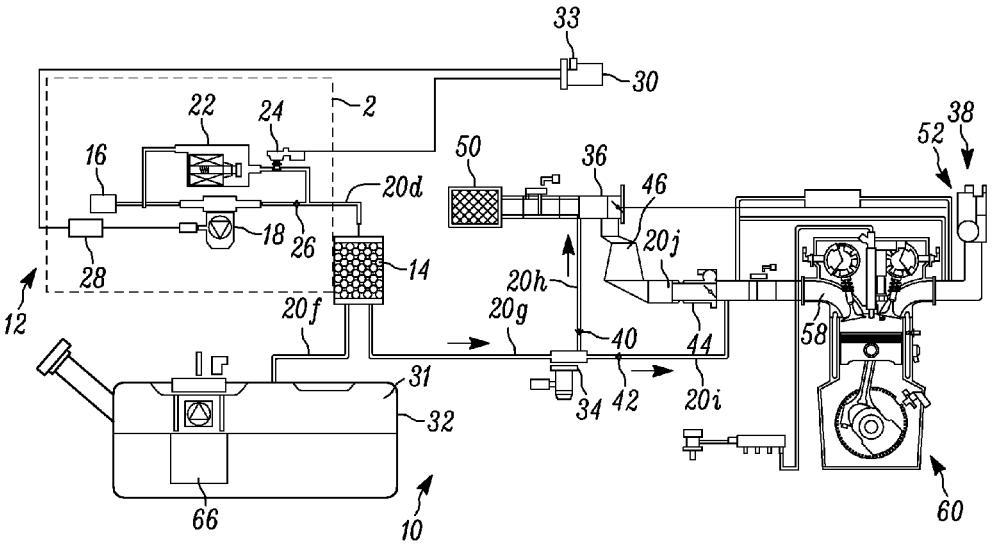
FIG. 1 is a diagram of an evaporative emission control system for a vehicle having an active purge pump system module, according to an embodiment.
Figure 2:
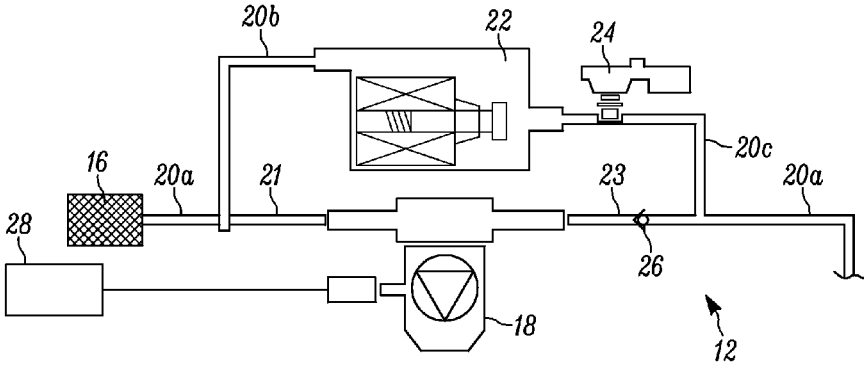
FIG. 2 is an enlarged view of the active purge pump system module enclosed at 2 in FIG. 1.

With reference to FIG. 1, an evaporative emission control system for a vehicle is shown, generally at 10, according to an embodiment. The system 10 includes an active purge pump system module, shown generally at 12, in accordance with an embodiment that is in fluid communication with a vapor collection canister such as a carbon canister 14. As best shown in FIG. 2, the module 12 includes an air inlet 16 including a filter, which intakes air from the atmosphere. The air inlet 16 is in fluid communication with an electrical pump 18 through the use of a conduit 20*a* and the outlet of the pump communicates with the canister 14 via conduit 20*a*. A bypass valve assembly 22 is in fluid communication with the conduit 20*a* through the use of conduit 20*b*. The bypass valve assembly 22 can be a latching valve or can be a normally open valve. A conduit 20*c* is connected to the bypass valve assembly 22 and a pressure sensor 24 is located in conduit 20*c*. The conduit 20*c* is connected to and in fluid communication with the downstream end of the conduit 20*a*. Thus, the bypass valve assembly 22 is in fluid communication with an upstream side 21 and downstream side 23 of the pump 18. The conduit 20*a* is also connected to the carbon canister 14. A first check valve 26 is disposed in the conduit 20*a* between the pump 18 and canister 14 to prevent backflow through the pump 18. The pump 18 is in electrical communication with a pump controller 28, and both the pump controller 28 and the pressure sensor 24 are in electrical communication with an electronic control unit (ECU) 30 (FIG. 1). The function of the module 12 will be explained below.

The carbon canister 14 is in fluid communication with a fuel tank 32 through the use of a conduit 20*f*, which is connected to both the carbon canister 14 and the fuel tank 32. Purge vapor 31 is able to flow from the fuel tank 32 into the carbon canister 14 through the conduit 20*f*. Also connected to the carbon canister 14 is a conduit 20*g* that is connected to a turbo purge valve (TPV) 34, for placing the carbon canister 14 in fluid communication with the TPV 34.

Two other conduits are also connected to the TPV 34. A conduit 20*h* is connected to the TPV 34 and to a compressor 36, which is part of a turbocharger unit, shown generally at 38, which also includes a turbine, shown generally at 52. A conduit 20*i* is connected to the TPV 34 and a conduit 20*j* is connected between a throttle assembly 44 and an intercooler 46. The intercooler 46 is connected to the compressor 36. A second check valve 40 is disposed in the conduit 20*h* and a third check valve 42 is disposed in the conduit 20*i*.

In operation of the system 10, air from the atmosphere is able to enter the system 10 through either of the air intakes or filters 16, 50. With the bypass valve assembly 22 in the opened position, vacuum from the engine 60 is used to draw air from air intake 50 which draws purge vapor 31 from the canister 14. The purge vapor 31 is draw into the conduit 20*g*, through the turbo purge valve 34, and eventually into the intake structure 58 of the engine, generally indicated at 60. This functionality provides for low flow restriction when the bypass valve assembly 22 is in the opened position and vacuum is available.

However, if the vacuum from the engine 60 is not sufficient, the bypass valve assembly 22 may be closed. In this situation, the module 12 is able to control the amount of inlet air that passes from the air intake of filter 16 into the system 10. The air passing into the conduit 20*a* is moved through the system 10 by the pump 18. When the valve assembly 22 is closed and the pump 18 is activated independently of the engine 60, air is forced through the conduit 20*a* to overcome the force of the check valve 26, opening the check valve 26 such that the air passes into the canister 14 forcing the purge vapor in the canister 14 into the conduit 20*g*, through the turbo purge valve 34, and eventually into the intake structure 58 of the engine 60. The control of the air flow generated by the pump 18 is controlled by using feedback from the pressure sensor 24 to the ECU 30, with the ECU 30 controlling the pump controller 28 and thus the pump 18. The pressure sensor 24 allows for flow control of the purge vapor during the purge operation. In this mode of operation, the bypass valve assembly 22, being in the closed position, allows for purging of the canister 14 with a high purge flow rate due to the pump 18 moving the air.

A processor circuit 33 of the ECU 30 may be programmed with a control strategy to offset the output pressure needed from the pump 18 by the amount of vacuum being detected in the intake 58, reducing the power consumption by the pump 18, while still providing the necessary flow of the purge vapor. The ECU 30 controls the flow for purging the canister 14, and also controls the pressure to adjust the speed of the pump 18. The flow generated by the pump 18 is adjusted for optimized electrical power consumption.

The operation of the purge pump system module 12 by employing the pump 18 allows for purge vapor to be removed from the canister 14 and transferred to the intake 58 of the engine 60 without the use of the compressor 36. This allows all of the air generated by the compressor 36 to be transferred to the engine 60, and provide a more efficient turbocharger unit 38.

One of the advantages of the embodiment is that the pump 18 may be used to generate flow through the canister 14 to direct purge vapor during any mode of operation of the engine 60.

Vehicle refueling is achieved with the pump 18 not operating and by opening the bypass valve assembly 22, allowing air to escape the fuel tank 32, while the purge vapor remains in the canister 14. This allows for refueling with low flow restriction.

Furthermore, the purge pump system module 12 may also be used to perform diagnostic testing. A diagnostic test for leak detection is performed when the pump 18 is activated to move air, and the bypass valve assembly 22 is closed, where the pressure sensor 24 is used to monitor a change in pressure in the system 10 over time. If there is a change in pressure, then there is a pressure leak in the system 10 that needs to be fixed. This leak detection function may be performed prior to the start of the engine 60 to check for leaks, so as to prevent the purge vapor from escaping to the environment. This diagnostic test for leak detection may also be performed when the engine 60 is running.

The pressure sensor 24 provides for pressure gradient analysis for leak monitoring and allows for component plausibility diagnosis of the electrical pump 18, the bypass valve assembly 22, the check valve 26, and the pressure sensor 24. The pressure sensor 24 also provides the functionality of allowing pressure control during the leak testing process, and is used to provide pressure control whether the diagnostic leak test is performed when the engine 60 is on or off.

Another function of the pump 18 is to generate over pressure in the fuel tank 32, which is also used to detect leaks. As this occurs, the bypass valve assembly 22 is in the closed position, allowing for tightness of the fuel tank 32 during leak monitoring.

The purge pump system module 12 of the embodiment also provides the functionality of controlling the rotation speed of the pump 18 to therefore control the flow rate of the purge vapor from the canister 14. The module 12 also allows for control of the rotation speed of the pump 18 to reduce noise generation of the pump 18 during the purge operation and leak monitoring operation.

Figure 3:
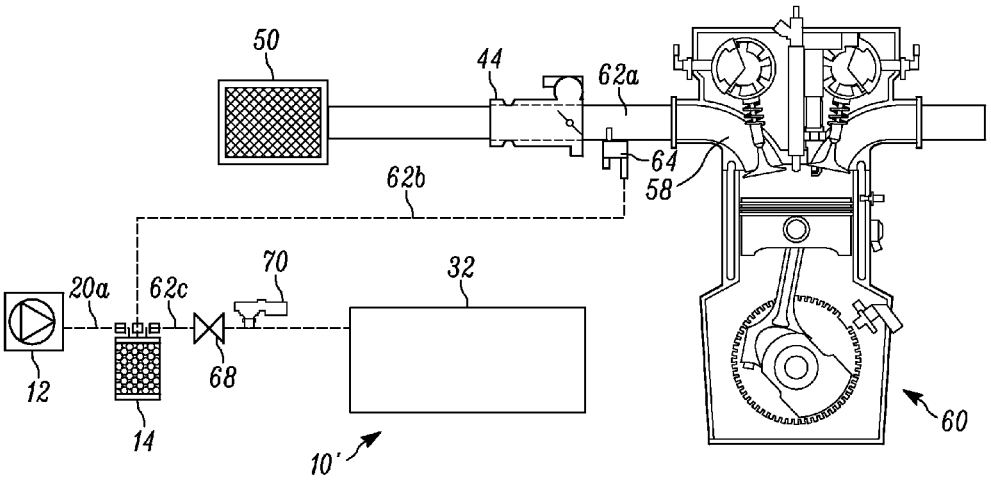
FIG. 3 is a diagram of an alternate embodiment of evaporative emission control system having an active purge pump system module.

An alternate embodiment of an evaporative emission control system 10' is shown in FIG. 3. In this embodiment, the pump system 12 is still connected to the carbon canister 14 through the conduit 20*a* in a similar manner to that which is shown in FIG. 1. However, the embodiment in FIG. 3 includes an engine 60 which is naturally aspirated, and therefore the turbocharger unit 38 of FIG. 1 and the components associated with the turbocharger unit 38 are not included in the embodiment of FIG. 3. A conduit 62*a* is connected to and provides fluid communication between the intake 58 and the throttle assembly 44. A purge valve 64 is connected to the conduit 62*a*. The purge valve 64 is also connected to and in fluid communication with another conduit 62*b*, which is connected to and in fluid communication with the canister 14.

Another conduit 62*c* is connected to the canister 14 and a fuel module 66, providing fluid communication between the canister 14 and a fuel tank 32. A tank isolation valve 68 and a pressure sensor 70 are in communication with the conduit 62*c*. The tank isolation valve 68 provides venting during refueling of the fuel tank 32, and vacuum relief during operation of the engine 60 as the fuel in the tank 32 is consumed. The pressure sensor 70 detects the pressure level in the fuel tank 32.

The pump system module 12 works in a substantially similar manner as shown in FIG. 1 and will be explained with reference to the components of the pump system module 12 shown in FIG. 1. When the pump 18 is not active, the bypass valve assembly 22 may be opened, and the vacuum from the engine 60 may be used to purge vapor from the canister 14 and into the conduit 62*b*, through the purge valve 64, the conduit 62*a*, and eventually into the intake 58 of the engine 60. This functionality provides for low flow restriction when the bypass valve assembly 22 is in the open position and vacuum is available. The bypass valve assembly 22 is opened during refueling.

If the vacuum from the engine 60 is not sufficient for purging of the canister 14, the bypass valve assembly 22 may be closed, and the pump 18 is then activated to move air that is forced through the conduit 20*a* to overcome the force of the check valve 26, opening the check valve 26 such that the air passes into the canister 14 to transfer purge vapor from the canister 14 through conduit 62*b*, through the purge valve 64, into conduit 62*a* and into the engine 60 to be consumed. In this mode of operation, the bypass valve assembly 22, being in the closed position, allows for purging of the canister 14 with a high purge flow rate because of the pump 18 moves the air.

Figure 4:
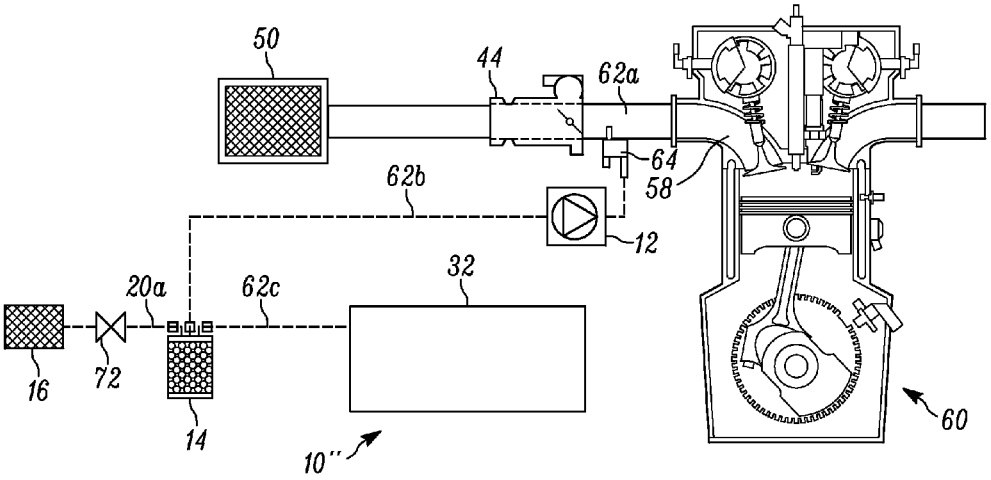
FIG. 4 is a diagram of another alternate embodiment of an evaporative emission control system having an active purge pump system module.

Another embodiment of an evaporative emission control system 10" is shown in FIG. 4. In the embodiment shown in FIG. 3, the pump system module 12 is located upstream of the canister 14. In the embodiment shown in FIG. 4, the pump module 12 is located downstream of the canister 14 in the conduit 62*b* and between the canister 14 and the purge valve 64. The embodiment shown in FIG. 4 also includes canister vent valve 72 associated with the air inlet/filter 16. In this embodiment, with the bypass valve assembly 22 being closed, the activated pump 18 pulls purge vapor from the canister 14 as opposed to pushing the purge vapor out of the canister (as in the embodiment shown in FIG. 3). The pulled purge vapor flows through the conduit 62*b*, through the purge valve 64, through the conduit 62*a*, and into the air intake 58 to be consumed by the engine 60.

When the pump 18 is deactivated, the bypass valve assembly 22 may be opened to allow vacuum pressure from the engine 60 to draw vapor from the canister 14 into the conduit 62*b* in a similar manner with regard to FIG. 3. The bypass valve assembly 22 is opened during refueling.

Figure 5:
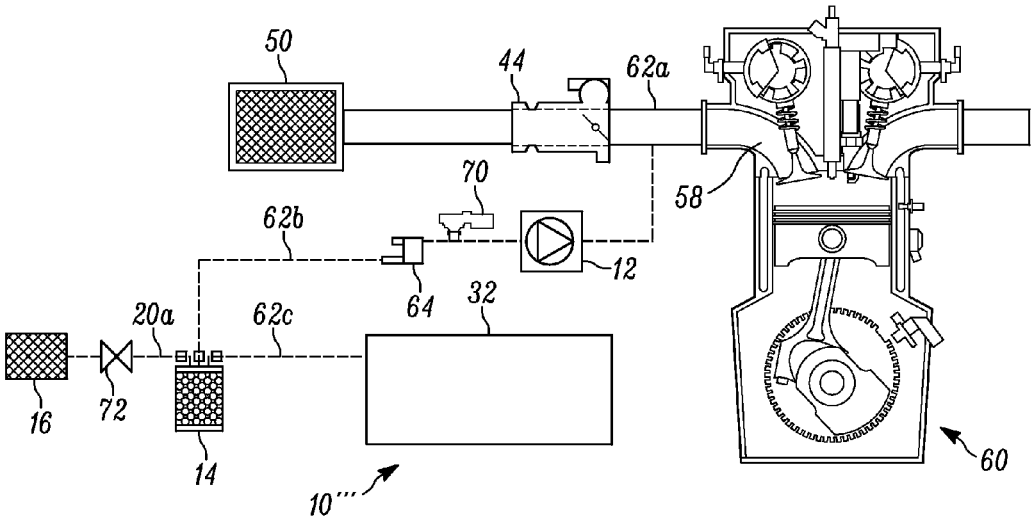
FIG. 5 is a diagram of yet another alternate embodiment of an evaporative emission control system having an active purge pump system module.

Another embodiment of an evaporative emission control system 10'" is shown in FIG. 5. In this embodiment, the pump system module 12, the purge valve 64, and the pressure sensor 70 are all disposed in the conduit 62*b* downstream from the canister 14. The pressure sensor 70 is located in the conduit 62*b* downstream from the purge valve 64, and the pump module 12 is located in the conduit 62*b* downstream from the pressure sensor 70. In this embodiment, the pump system module 12 pulls purge vapor from the canister 14 in a similar manner to the embodiment shown in FIG. 4.

In the embodiment shown in FIG. 5, there is a diagnostic feature to address the portion of the conduit 62*b* located between the pump system module 12 and the conduit 62*a* becoming disconnected, with the possibility of the pump 18 of module 12 pushing fuel vapor into the atmosphere. This diagnostic check is performed by the use of the pressure sensor 70 located upstream of the pump system module 12. Because there is vacuum pressure in the intake 58, there is a small amount of vacuum pressure in the conduit 62*a* downstream of the air filter 50 and, when the conduit 62*b* is properly connected, vacuum pressure is in the conduit 62*b* as well. Because there is continuous fluid communication between the conduit 62*a* and the pressure sensor 70 through the pump system module 12 when the pump 18 is idle, the presence of vacuum pressure detected by the pressure sensor 70 confirms that the conduit 62*b* is still attached to the pump module 12 and the conduit 62*a*, with no purge vapor escaping to atmosphere.

The configuration of the pump system module 12 shown in FIGS. 5 has several benefits. The pump system module 12 is located in the engine compartment, and may be located either upstream or downstream of the canister 14. One of the advantages to this configuration is that the noise level from the pump 18 is less noticeable in the vehicle. Additionally, compared to a location on the fresh air side (upstream) of the canister 14, the cost of the tank isolation valve 68 and bypass valve assembly 22 for on-board refueling vapor recovery (ORVR) is avoided.

If the pump system module 12 is downstream of the purge valve 64, and the pressure sensor 70 is between the purge valve 64 and inlet of the pump 18 as shown in FIG. 5, then the pressure sensor 70 may be used for flow control, and to perform the diagnostic check to determine if the portion of the conduit 62*b* connected to the conduit 62*a* is connected.

Another advantage of the embodiments is that the pump 18 is a high-speed pump. This smaller pump 18 has lower power consumption, but still provides for sufficient flow because the motor of the pump 18 is a high-speed motor used with a centrifugal impeller. Furthermore, the purge valve 64 is a low-restriction purge valve, which also allows for sufficient flow rate when the high-speed motor is used.

In one embodiment, the rotational speed of the motor in the pump 18 operating at full flow rate is about 50,000-60,000 rpm, but is within the scope of the invention that greater or lesser rotational speeds may be used. Compared to a similarly styled pump which has a maximum rotational speed when operating at full flow rate of 5000-6000 rpm, the diameter of the motor used with the pump 18 in FIGS. 1-5 may be reduced by at least 50%. In the embodiments shown in FIGS. 1-5, the diameter of the motor used with the pump 18 is reduced by 67%.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the scope of the following claims.

What is claimed is:

1. An active purge pump system module for an evaporative emission control system for a vehicle, the evaporative emission control system including a fuel tank, a vapor collection canister in communication with the fuel tank, an air intake directing air to an internal combustion engine of the vehicle, and a purge valve connected between the canister and the air intake, the active purge pump system module comprising:

a pump in fluid communication with the canister, the pump being constructed and arranged to move air independently of operation of the engine; and a bypass valve assembly in fluid communication with an upstream side and a downstream side of the pump so as to bypass the pump, the bypass valve assembly being constructed and arranged to be moved between opened and closed position such that when in the closed position, the pump, when activated, is constructed and arranged to move purge vapor from the canister, through the purge valve, and to the engine to be consumed during combustion, and when the bypass valve assembly is opened and the pump is deactivated, vehicle refueling is permitted.

2. The module of claim 1, further comprising a pump controller connected to an electronic control unit, the pump controller being constructed and arranged to control operation of the pump based on commands from the electronic control unit.

3. The module of claim 2, further comprising a pressure sensor in fluid communication with bypass valve assembly, the pump, and the canister, the pressure sensor being constructed and arranged to detect a change in pressure when the pump is activated, when the bypass valve assembly is in the closed position, and when the purge valve is in the closed position.

4. The module of claim 3, wherein the pressure sensor is electrically connected to the electronic control unit so that based on a detected change in pressure by the pressure sensor, air flow generated by the pump can be controlled by the pump controller.

5. The module of claim 3, in combination with the evaporative emission control system, wherein the pressure sensor is electrically connected to the electronic control unit so that when the pump is activated and the bypass valve assembly is closed, the pressure sensor is constructed and arranged to detect changes in pressure to determine if a pressure leak exists in the evaporative emission control system.

6. The module of claim 1, further comprising an air inlet in communication with the pump so that the pump can draw in atmospheric air through the air inlet.

7. The module of claim 1, further comprising a check valve downstream of the pump and upstream of the canister to prevent backflow through the pump.

8. The module of claim 1, in combination with the evaporative emission control system, wherein the pump and the bypass valve assembly are disposed upstream of the canister so that the pump pushes the purge vapor from the canister.

9. The module of claim 1, in combination with the evaporative emission control system, wherein the pump and the bypass valve assembly are disposed downstream of the canister so that the pump pulls the purge vapor from the canister.

10. The combination of claim 9, wherein the pump and bypass valve assembly are disposed between the air intake and the purge valve and the combination further comprises a pressure sensor disposed between the purge valve and an inlet of the pump, the pressure sensor being constructed and arranged to determine if vacuum pressure exists between an outlet of the pump and the air intake.

11. The module of claim 1, wherein the pump has a high-speed motor and a centrifugal impeller.

12. The module of claim 11, wherein the pump is constructed and arranged to operate at full flow rate at about 50,000-60,000 rpm.

13. The module of claim 1, in combination with the evaporative emission control system so that when the bypass valve assembly is in the opened position and the pump is not active, the engine is constructed and arranged to create a vacuum to draw purge vapor from the canister, through the purge valve, and into the air intake.

14. The module of claim 1, in combination with the evaporative emission control system, the evaporative control system further comprising a turbocharger unit have a compressor for generating airflow, such that when the bypass valve is closed, substantially all of the airflow generated by the compressor flows into the air intake.

15. A method of purging vapor from a vehicle, the vehicle having an evaporative emission control system including a fuel tank, a vapor collection canister in communication with the fuel tank, an air intake directing air to an internal combustion engine of the vehicle, and a purge valve connected between the canister and the air intake, method comprising the steps of:

providing a pump in fluid communication with the canister, operating the pump independently of the engine to move purge vapor from the canister, through the opened purge valve, and to the engine to be consumed during combustion;

providing a bypass valve assembly in fluid communication with an upstream side and a downstream side of the PUMP so as to bypass the PUMP, the bypass valve assembly being constructed and arranged to be moved between opened and closed position, and prior to the operating step, moving the bypass valve assembly to the closed position.

16. The method of claim 15, further comprising:

moving the bypass valve assembly to the opened position and deactivating the pump thereby permitting refueling of the vehicle.

17. The method of claim 15, further comprising:

providing a pressure sensor associated with the pump, and with the bypass valve assembly and the purge valve in the closed position and with the pump activated, monitoring pressure in the evaporative emission control system with the pressure sensor.

18. The method of claim 15, wherein the step of moving purge vapor includes operating the pump to pull or pushing the purge vapor.

* * * * *